United States Patent [19]

Hawthorne et al.

[11] 4,015,674

[45] Apr. 5, 1977

[54] APPARATUS FOR UNITIZING A PAIR OF AUGERS

[75] Inventors: Arthur L. Hawthorne, St. Clairsville, Ohio; David R. Hazen, McMurray, Pa.

[73] Assignee: Consolidation Coal Company, Pittsburgh, Pa.

[22] Filed: May 2, 1975

[21] Appl. No.: 574,071

[52] U.S. Cl. ..... 175/91; 175/323; 175/325; 175/394

[51] Int. Cl.[2] ..... E21C 13/04

[58] Field of Search ..... 175/91, 24, 73, 76, 175/394, 323, 325; 299/55, 56, 57

[56] References Cited

UNITED STATES PATENTS

| | | | |
|---|---|---|---|
| 837,490 | 12/1906 | Nelson | 175/394 |
| 3,083,955 | 4/1953 | Compton | 299/56 |
| 3,746,110 | 7/1973 | Young et al. | 299/56 X |

*Primary Examiner*—Ernest R. Purser
*Assistant Examiner*—William F. Pate III
*Attorney, Agent, or Firm*—William J. Miller

[57] ABSTRACT

Apparatus for unitizing a pair of side-by-side augers when each auger includes a shaft, a mateable rotational coupling on each end of the shaft, and flightings along the shaft, the unitizing apparatus includes bearings which are journaled on each end of the shaft and spacers pivotally attached between each of the bearings on the same end of the shaft in order to align the axis of the shafts substantially parallel with each other. A longitudinal support member is rigidly secured beween the spacers and between each of the flightings. A joining clevis is attached to the spacers so that they face in a manner to mate for interconnection with subsequent or preceding unitized assemblies.

7 Claims, 4 Drawing Figures

APPARATUS FOR UNITIZING A PAIR OF AUGERS

BRIEF DESCRIPTION OF THE PRIOR ART

One method for removing minerals, such as coal, from a horizontal seam is to utilize a pair of side-by-side cutting heads connected axially to a pair of augers which are used to convey the material once cut out of the hole. One or more pairs of augers may be utilized depending upon the depth of the hole. Each auger is powered by a machine which applies axial as well as rotational forces to the augers to both force the augers and the cutting heads into the seam being mined and to rotate the cutting heads breaking away the material wherein the augers will then convey the material from the hole. On occasions in order to prevent the pair of augers from being forced apart, spacers have been applied for example after each three to four sets of augers, to tie the auger pairs together.

Even with the use of spacers, however, each individual auger was normally stored and lifted singly and connected to the machine. Thus, in the case of auger pairs, two augers were individually lifted, laid side-by-side, and coupled to the auger pair already preceding the new set in the hole. Once the augers were properly placed and coupled to the preceding auger pair, pins were inserted through the couplings in order to provide a means for removing the auger pairs from the hole once the maximum depth had been reached or in case the auger pair needed to be removed for some other mechanical reason. Since the pins rotate with the auger pair, the pins were necessarily inserted and locked in by any usual means, such as a clip or cotter pin. It is obvious, of course, that once the augers were removed, the pins would be in any rotational position, either necessitating individual rotation of each auger to properly remove the pins or making the removal of the pins more difficult.

BRIEF DESCRIPTION OF THE INVENTION

This invention describes a method for coupling two auger pairs which are normally positioned side-by-side so that the auger pair can be handled as a single unit. The unitized pair has several advantages over the individual side-by-side augers. First, the unitized pair requires much less time to handle, either removing or inserting, during the mining operation. Second, each unitized auger pair requires only a single pin to join one pair with the preceding pair. The pin will also always be facing upward, thereby providing an easy method for removal. Futhermore, since the pin does not rotate, no locking system need be used to retain the pin during the augering operation. The method for unitizing the auger pair also provides other advantages, such as providing a means for supporting the auger pair off the ground and a means for conveying electrical wires along the auger pair in order to control the direction of the drilling operation.

The augers are unitized by mounting bearings around each end of the individual augers. A spacing bar is mounted between the bearings and pivotally secured to the bearings. A longitudinal bar is connected between each of the spacing bars and rigidly attached to the spacing bars. A joining coupler is connected to each of the spacing bars and utilizes a pin or clevis arrangement to connect one unitized auger pair with a subsequent or preceding unitized auger pair. The center bar can also be utilized to carry wires to communicate with the sensing apparatus at the cutting end of the auger string; furthermore, the center bar can also be used to support the auger string off the ground in order to reduce the rotational horsepower of the augers.

RELATED APPLICATIONS

An application titled "Support System for a Unitized Pair of Augers" by Hawthorne and Hazen, Ser. No. 574,135, filed 5-02-75, and an application titled "Wire Communications Channel for a Pair of Unitized Augers" by Hawthorne and Hazen, Ser. No. 574,186, filed 5/2/75, are related to this application.

DETAILED DESCRIPTION OF THE INVENTION

Similar numbers will be used throughout this specification for similar elements.

Figure 1:
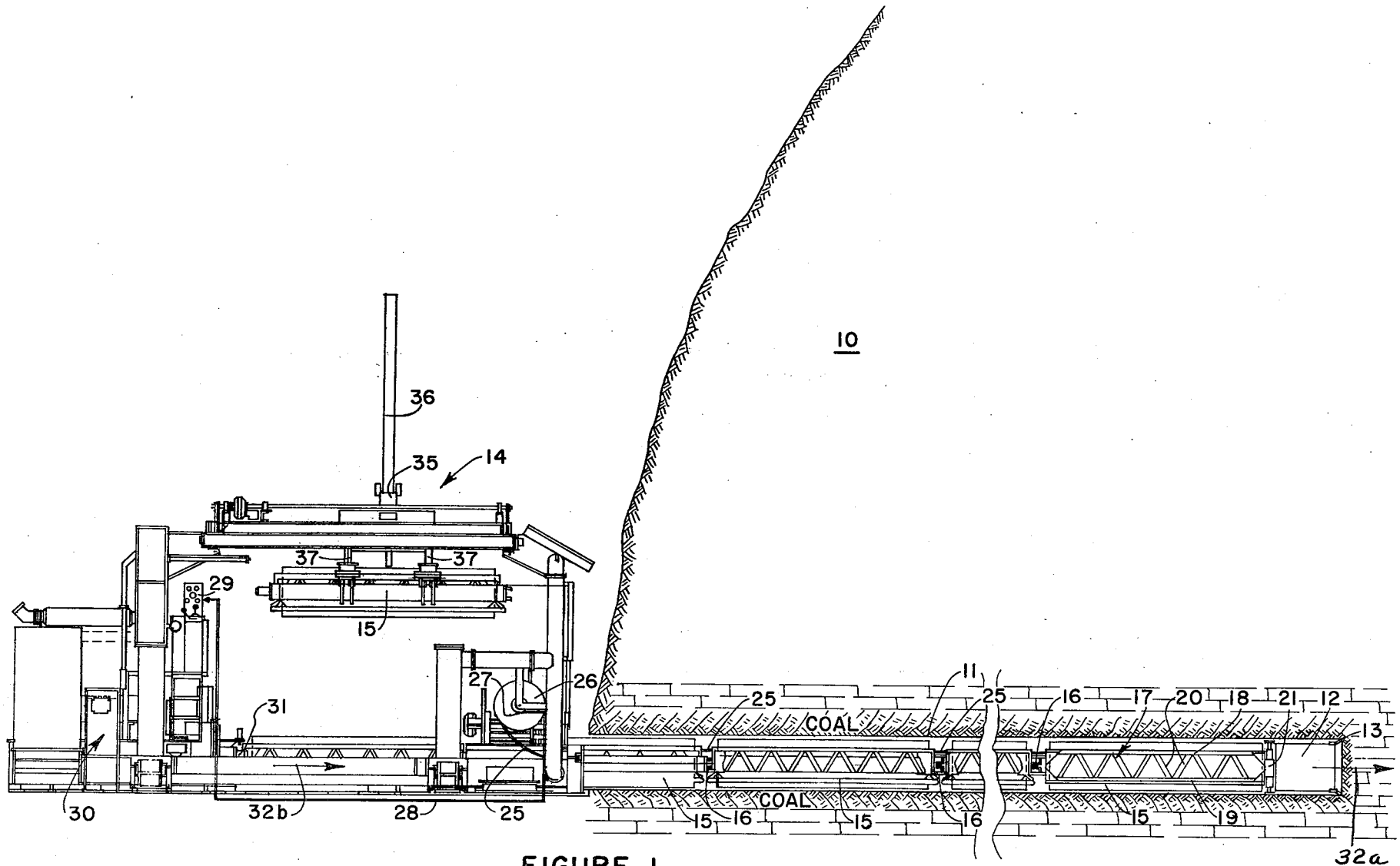
FIG. 1 is a cross-sectional view of a hillside illustrating the augering machine outside the hillside and several auger pairs inside the hillside during a mining operation.

Referring to FIG. 1, a hillside generally referred to by the number 10 has a mined-out portion 11 being cut by a pair of cutters 12 having teeth 13. An augering machine generally referred to by the arrow 14 has a plurality of unitized auger sections 15 attached to its power output source. Each of the unitized sections illustrated in FIG. 1 has one auger conveyer removed in order to illustrate the horizontal support system in better detail. The horizontal support system will be described specifically in subsequent figures.

A joining coupling 16 is attached to a spacer bar not shown in FIG. 1. The spacer bar is attached to a longitudinal member 17. Longitudinal member 17 may consist of a top channel 18 and a bottom channel 19 connected by a plurality of diagonal braces 20 to form a truss.

A directional control apparatus 21 is mounted between the last unitized section 15 and drilling cutter heads 12 and may include jacking means for example to force the cutter heads 12 upwardly or downwardly and may also include sensing equipment, for example, to determine the center of the coal seam, the direction the hole is being drilled, and other pertinent information to the drilling of a long horizontal hole. The directional information and coal seam thickness information do not form a part of this invention and will not be further discussed in this application. The electrical connections to the directional control apparatus contained in the vicinity of the cutter heads 12 are coupled through wires 25 to a reel 26. Brushes 27 on reel 26 convey the information to wires 28 to a control system 29 on augering apparatus 14. Augering apparatus 14 generally includes a power source referred to by an arrow 30 which is coupled at 31 to the unitized auger sections. It is obvious, of course, that each of the individual augers is individually driven through a gear box to power source 30. It is also obvious that not only rotational force is developed to the drive system, but also axial pressure is developed along the length of the unitized sections by power system 30. Thus, as cutter heads 12 cut into hillside 10 in the direction of arrow 32A, the unitized augers will move in the direction of arrow 32B.

Augering machine 14 also includes a crane apparatus 35 which has a hydraulic lift 36 for attaching through arms 37 to unitized auger section 15. In the ordinary course of operation, the crane or lift 35 will pick up a unitized section settin beside the auger machine, lift it up, and lower it into the machine bed. Such a machine is currently being manufactured by the Salem Tool Company located in Salem, Ohio, and is readily available.

Figure 3:
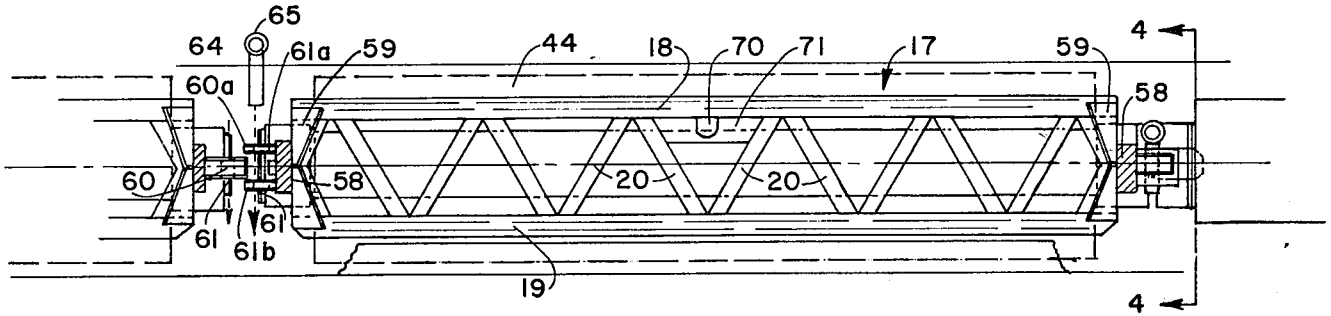
FIG. 3 is a side view of a unitized augering pair taken through the lines 3—3 of FIG. 2; and, FIG. 4 is an end view of the augering pair shown in FIG. 2.
Figure 2:
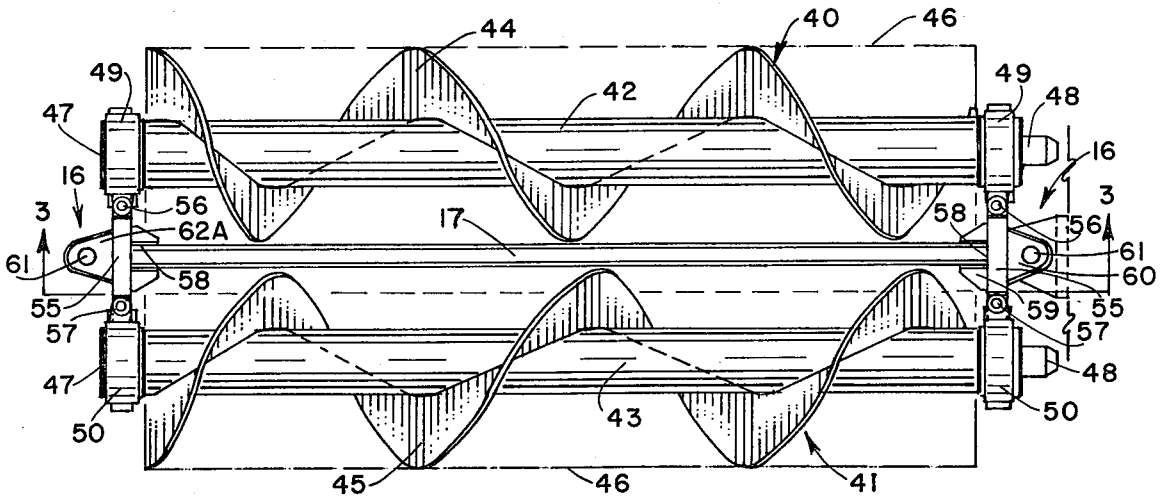
FIG. 2 is a top view of a unitized augering pair.
Figure 4:
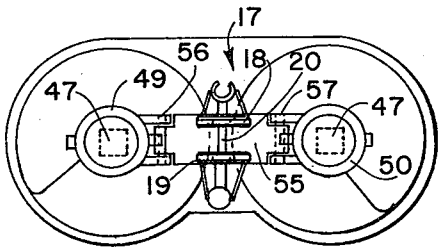

Referring to FIGS. 2, 3, and 4, but in particular to FIG. 2, a pair of augers are unitized in the following manner. Augers 40 and 41 have shafts 42 and 43, respectively. Shaft 42 has a flight 44 attached to it, and shaft 43 has a flight 45 attached thereto, Each flight will generate a surface illustrated by dotted lines 46. Shafts 42 and 43 each have a female coupling 47 and a male coupling 48. Both couplings 47 and 48 are square so that rotational forces can be delivered to the shaft causing it to turn. Around shafts 42 and 43 are mounted bearings 49 and 50, respectively, at each end between couplings 47 and 48 and flight 44 for example on shaft 42 and between couplings 47 and 48 and flight 45 on shaft 43. A transverse spacing member 55 is attached through pivots 56 and 57 to the housing of bearings 49 and 50, respectively. Transverse spacing member 55 is attached in exactly the same manner at the opposite end of shafts 42 and 43.

Longitudinal support member 17 is rigidly attached to spacer member 55 at 58 by use of plates 59 and welding or any other well-known or usual means.

A clevis type coupling is utilized to couple one unitized augering pair 15 to a second unitized augering pair 15. Such a clevis type coupling 16 has a male portion 60 with a vertical opening 61 adapted to receive a pin therethrough. The mating portion is formed by an upper piece 62A and a lower piece 62B. Pieces 62A and 62B have a corresponding opening 61 for receiving a pin. Such a pin is illustrated as 64 and may have a removable ring 65 attached thereto. It should be noted at this point that no locking mechanism is necessary to retain the pin in openings 61 since at no time will the pin or the pin mounting be rotated. An opening 70 may be formed in a plate 71 which is attached between angle bracers 20. Opening 70 can be used for lifting or lowering the assembly.

OPERATION

Referring to all of the figures, the device operates as follows:

An assembly 15 as previously described was formed having a rigid longitudinal member 17 securely attached to transverse members 55. Pivots 56 which are connected to bearings 50 permit some alignment of shafts 42 and 43 with subsequent assemblies 15. Thus, if there is a slight difference in spacing or slight misalignment, the pivots will permit a correction in alignment of the shafts.

Clevises 16 permit an easy method of assembling several units 15 to form a series of units. In the prior art systems, the augers were assembled by mating male coupling 48 with female coupling 47. A pinhole was then provided through the female coupling and the male coupling, and a pin was inserted through this hole and locked underneath by any usual means, such as a cotter pin. The pin is necessary since in order to retrieve the unit, tension must be placed on these couplings. If no pin were present, the couplings would merely uncouple, leaving all but the last augering unit in the hole. The longitudinal member 17 provides an easy method for picking up the entire assembly by hydraulic hoist 36 since arms 37 need only couple to the horizontal member 17, lifting both augering units from storage and inserting them in place for use or the converse lifting them out of the augering machine bed and returning them to storage. The center longitudinal member also provides several other unique advantages which are described and claimed in the related applications set out in the introduction to this specification.

The spacing bar 55 also provides a means for continuously aligning the axis of shafts 42 and 43 so that they will at all times remain substantially parallel. The unit as constructed will reduce considerably the amount of time necessary to place or remove an augering pair during a mining operation. As an example, both augers are removed simultaneously rather than each auger individually. Second, the entire assembly is pinned through a single mating coupling rather than through each of the shafts. Third, the pin for joining the individual unitized auger pairs will always be in an upright position rather than at any angle depending upon the position where the auger shafts 42 and 43 stopped rotating. Furthermore, pin 64 can be made much larger and therefore able to take much more tension than could individual pins through couplings 47 and 48. Pins through these couplings will be limited in diameter, to the strength required in couplings 47 and 48. Obviously, if the pinhole is too large in diameter, the couplings 47 and 48 will be reduced severely in their rotational torque capabilities. However, the clevis 16 can be made as strong as necessary and obviously far greater in strength than the combined strength of the individual pins of the prior art.

CONCLUSIONS

A unique invention has been disclosed where a pair of side-by-side augers are coupled to form a unitized assembly. The unitized assembly has many advantages over the individual augers in that it provides an easy method for handling the augers, it provides for superior tension capabilities in removing the augers, if furthermore provides for a quicker means of assembling or disassembling the couplings, and also as is mentioned in subsequent applications it provides an easy means for supporing the auger assemblies and for providing a communication means to the control apparatus near the cutter head.

Modifications and changes can be made in this apparatus and still be well within the scope of this invention as illustrated in the specification and the appended claims.

What we claim is:

1. Apparatus for unitizing a pair of side-by-side augers wherein each auger includes a shaft adapted to rotate about its axis having rotational coupling means at each end and flightings along its length, said apparatus comprising:

a. bearing means rotatably mounted on each of said shafts;

b. spacing means pivotally secured to each of said bearing means and between said pair of augers to align the rotational axis of said shafts substantially parallel with each other; and c. joining means attached to said spacer means to secure said auger pair with another said rotatably coupled auger pair.

2. Apparatus as described in claim 1 wherein said bearing means comprises bearings at each end of said shaft and wherein said spacing means includes a pair of rigidly transverse members each attached between said bearings on corresponding ends of said shafts.

3. Apparatus as described in claim 2 including a longitudinal member rigidly attached to said rigid transverse member and between said pair of side-by-side augers.

4. Apparatus as described in claim 2 including a clevis having mating portions attached to each of said respective ones of said rigid transverse members for said interconnection.

5. Apparatus for unitizing a pair of side-by-side augers wherein each auger includes a shaft having first ans second ends, with flightings around said shaft, and first and second rotational coupling means at said first and second ends respectively, said apparatus comprising:

a. a first and second bearing means mounted around each of said shafts at said frist and second ends respectively;

b. first and second spacing means positioned between said shafts and transverse to the axis of said shafts and pivotally attached to said first and second bearing means respectively;

c. longitudinal spacing means rigidly attached between said first and second spacing means; and d. joining means for coupling said auger pair to another said auger pair.

6. Apparatus as defined in claim 5 wherein said joining means comprises a clevis-type coupling having the u-shaped portion attached to one of said spacer means and a mating portion attached to said remaining spacer means.

7. In an apparatus for boring a horizontal hole in the earth including a pair of cutting heads connected to a plurality of interconnected pairs of augers driven by a power system wherein each auger includes at least a shaft, mateable rotational coupling means on each end of said shaft and flightings along said shaft, the improvement comprising:

a. bearing means journaling each end of each shaft;

b. spacing means pivotally attached between each pair of bearings on the same end of said shafts to align the axis of said shafts substantially parallel with each other;

c. longitudinal support means rigidly secured between said spacing means and between said flights; and d. joining means attached to said spacing means and facing in a manner to mate for interconnection with the coupling means on the adjacent interconnected pair of augers.

* * * * *